United States Patent [19]

Rastorguyeff

[11] 4,219,191

[45] Aug. 26, 1980

[54] DOCUMENT FEEDING APPARATUS

[75] Inventor: Andrew W. Rastorguyeff, Norwalk, Conn.

[73] Assignee: Pitney Bowes Inc., Stamford, Conn.

[21] Appl. No.: 1,617

[22] Filed: Jan. 8, 1979

[51] Int. Cl.[3] ..... B65H 1/06; B65H 3/04

[52] U.S. Cl. ..... 271/3.1; 271/35; 271/94; 271/171

[58] Field of Search ..... 271/3.1, 35, 94, 165, 271/166, 171, 178, 207

[56] References Cited

U.S. PATENT DOCUMENTS

| | | | |
|---|---|---|---|
| 3,212,772 | 10/1965 | Ward | 271/35 X |
| 3,776,544 | 12/1973 | Watson et al. | 271/35 X |
| 4,081,181 | 3/1978 | Crowe et al. | 271/165 X |

FOREIGN PATENT DOCUMENTS

| | | | |
|---|---|---|---|
| 565736 | 12/1932 | Fed. Rep. of Germany | 271/94 |
| 1531481 | 5/1968 | France | 271/3.1 |

*Primary Examiner*—Robert W. Saifer

*Attorney, Agent, or Firm*—Peter Vrahotes; William D. Soltow, Jr.; Albert W. Scribner

[57] ABSTRACT

A document feeding apparatus has a deck that is placed at an angle such that the incline of the deck is sufficiently large so as to overcome the friction of documents placed thereupon. The deck has an opening at the bottom thereof through which a vacuum type conveyor extends to engage the bottommost document of the stack of documents to transport the bottommost document generally upwardly. With this feeding of the bottommost document the balance of the documents will remain in position due to the effect of gravity whereas the next-to-bottom sheet will be released from the bottommost sheet since the angle of incline is sufficiently great to overcome the frictional forces acting between these two documents.

4 Claims, 2 Drawing Figures

DOCUMENT FEEDING APPARATUS

BACKGROUND OF THE INVENTION

In activities involving document feeding, a need has existed for a feeding apparatus that is able to feed documents of different thicknesses and a feeding apparatus that acts as a buffer between adjacent conveyors. The latter need is occasioned by two conveyors placed in line with one another wherein the feeding conveyor operates at times faster than the receiving conveyor. In this situation some type of buffer mechanism is required between the fast and slow conveyor so that the documents may be stored and simultaneously supplied to the slower operating conveyor in the same sequence without any mishap. An example of the need of such a buffer mechanism is between a variable speed collator and an inserter.

Although many different combinations have been attempted for both a mixed thickness document feeder and an acceptable buffer, to the inventor's knowledge there is no single device that is capable of serving both functions satisfactorily.

SUMMARY OF THE INVENTION

A document feeding apparatus has been devised that may serve as both a buffer between in-line document conveyors and a mix thickness document feeder. This apparatus has an inclined deck, the deck being placed at an angle relative to the horizontal such that the incline is sufficiently large so that the friction between adjacent documents of a stack of documents that is placed upon the incline deck is such that the documents would tend to slide relative to one another. A stop means is mounted on the deck to prevent the stack of documents from sliding off the deck. The deck has an opening in the bottom thereof to receive a vacuum type conveyor that engages the bottommost document of the stack of documents. As the bottommost document is acted upon by the vacuum type conveyor, the friction is overcome between the bottom-most and the next-to-bottom document so that the bottommost document is conveyed away from the stack while the balance of the documents remain in the stack.

DETAILED DESCRIPTION

Figures 1, 2:
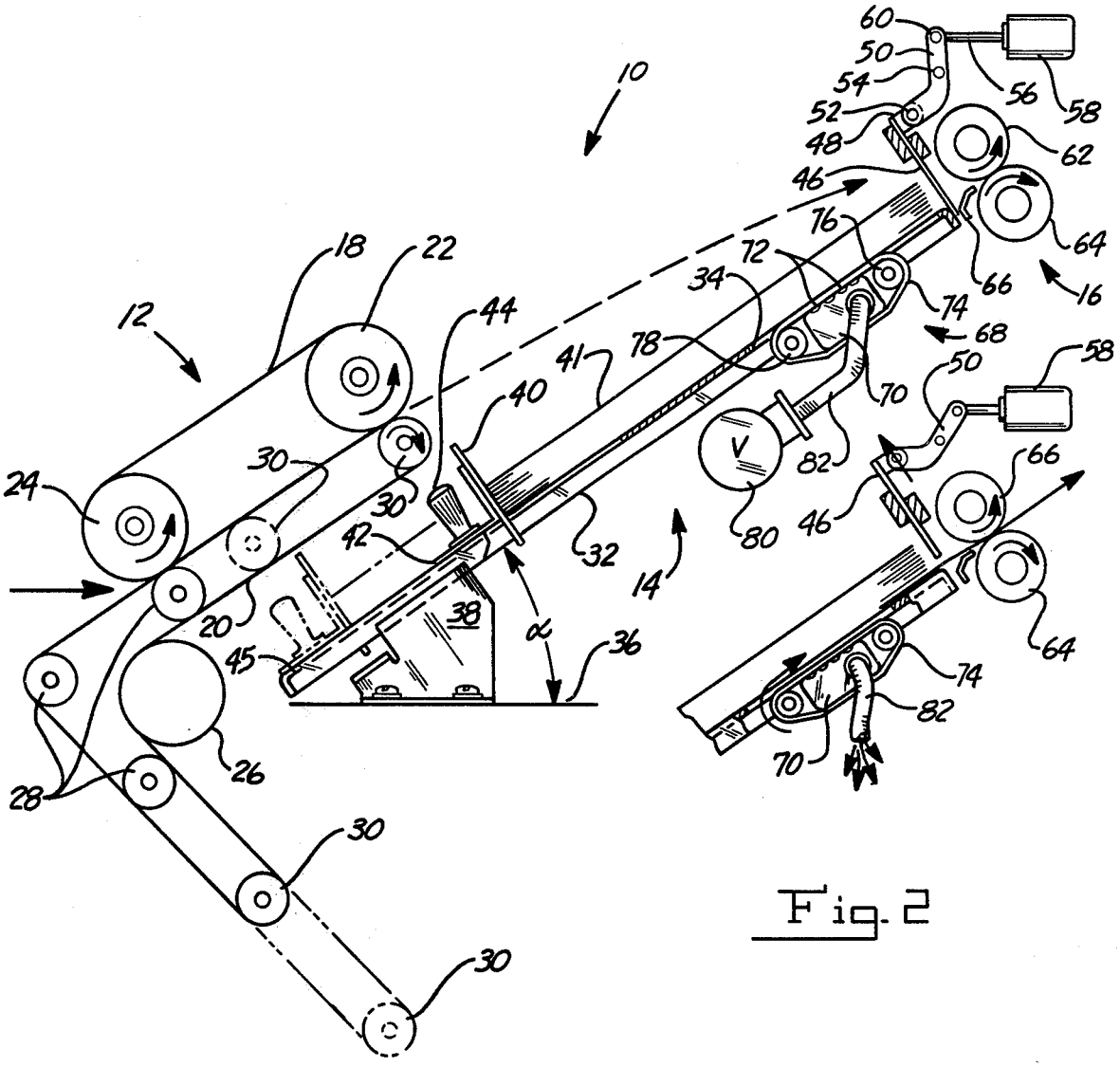
FIG. 1 shows a longitudinal cross-sectional view of a document conveying apparatus that incorporates the principles of the instant invention.
FIG. 2 is a view similar to FIG. 1 showing a portion of the apparatus in a different mode of operation.

Referring now to the drawing, a document feeding apparatus is shown generally at 10 and includes a document feeding mechanism 12, which may serve the output of the collator at the upstream end of the apparatus, a buffer unit 14 and a take-away unit 16 at the downstream end which may be the input of an inserter. Throughout this specification the term document includes all flat paper and paper-like items such as envelopes, cards, sheets, pages, and the like. The document feeding mechanism 12 includes an upper belt 18 that is trained about a drive roller 22 and an idler roller 24. Located below the upper belt 18 is a lower belt 20 that is trained about a drive roller 26 and a plurality of idler rollers 28, 30. The two extreme idler rollers 30 have adjustable positions indicated in FIG. 1 so as to adjust the location of the downstream end of the bottom belt 20 without loosening the tension in the lower belt.

Located downstream from and below the document feeding mechanism 12 is the buffer unit 14 that includes a deck 32 having an opening 34 therein. The deck 32 is secured to a housing 36 by a brace 38 at an angle relative to the horizontal indicated by the alpha in FIG. 1 with the lowermost portion of the deck located at its upstream end. Disposed upon the deck 32 is a wall 40 that cooperates with the deck to support a stack of documents 41. The wall 40 is integral with an L-shaped bracket 42. An adjustable handle 44 is received within the bracket 42 and an elongated opening 45 in the deck 32 to provide adjustment of the position wall 40 on the deck. The means for providing such adjustment and securing of the handle 44 is well known in the art and may be of any known type. Through adjustment of the location of the wall 40 and adjustment of the location of the downstream end of the lower belt 20, documents 41 of different lengths may be received upon the deck 32. Opposed to the wall 40 is a movable wall 46 that has a boss 48 at the upper portion thereof. The boss 48 is connected to a link 50 by a pin 52, the link being pivotable about a pivot pin 54. The link 50 is connected to a piston 56 of a solenoid 58 by a pin 60, which solenoid provides rotation of the link 50 about the pivot pin 54 thereby providing means for lifting and lowering the wall 46. Located below the link 50 adjacent the downstream end of the deck 32 is the take-away unit 16 that includes an upper drive roller 62, a lower idle roller 64 and a guide member 66 located adjacent the nip of these two rollers.

The buffer unit 14 includes a vacuum conveying member shown generally at 68. The vacuum conveying member 68 has a chamber 70 with a plurality of openings 72 at the upper portion thereof. A foraminous belt 74 is trained about a drive roller 76 and an idle roller 78. The foraminous belt 74 is in contact with the chamber 70 and the lowermost document 41 such that the lowermost document is held fast to the belt by vacuum in the chamber 70. A vacuum pump 80 is in a confluent relationship with the chamber 70 through a tube 82 to create a vacuum within the chamber.

In operation, documents 41 are supplied to the document feeding mechanism 12 as indicated by the solid arrow in FIG. 1. The documents 41 would then be fed by the belts 18, 20 to the buffer unit 14 as indicated by the broken arrow in FIG. 1. As the documents 41 are being fed, the wall 46 is in its lowermost position as seen in FIG. 1 so that the documents will not inadvertently overshoot the deck 32 and be fed directly from the document feeding mechanism 12 to the take-away rollers 62, 64. Upon the documents 41 being fed to the buffer unit 14 they come to rest upon the deck 32 and are prevented from sliding by the wall 40. The location of the wall 40 may be adjusted to accommodate the length of the documents 41. After a sufficient number of documents 41 is disposed upon the deck 32, the solenoid 58 is enabled to rotate the link 50 about the pivot pin 54 to lift the wall 46 as shown in FIG. 2. In this position, the wall 46 is spaced relative to the deck 32 to provide room for documents 41 to be conveyed from the bottom of the stack to the take-away rollers 62, 64. Upon the lifting of the wall 46 the drive roller 76 may be actuated so that the belt 74 will rotate in a clockwise direction as shown in FIG. 2. The vacuum pump 80 is also enabled so that a vacuum is created in the chamber 70. Because of the openings 72 located in the chamber, the bottom-most document 41 of the stack will be held fast to the belt 74 and as the belt 74 rotates about the rollers 76, 78, the lowermost document 41 of the stack will be conveyed between the raised wall 46 and the plate 32 to the take-away unit 16.

The angle alpha between the housing 36 and the deck 32 is so chosen that the friction between the documents is overcome by gravity due to the degree of the angle. The angle alpha must be sufficiently great so that the friction between all the documents is overcome. An example of such an angle is 35°.

It is necessary that there be positive engagement between the bottom document 41 and the conveying member that is to separate such document from the stack. This positive engagement is required in order to provide sufficient force to overcome the friction between the bottom document 41 and the next-to-bottom document. This is particularly true when the documents 41 consist of a plurality of connected pages. The preferable engagement means is vacuum means as described heretofore.

As will be noted, the sheet feeding mechanism 12 may be operated so as to feed documents at a faster rate than the rate at which the take-away rollers 62, 64 convey the documents for further processing and there is no problem because of the presence of the buffer unit 14. It will be appreciated that the documents 41 are fed to the take-away rollers 62, 64 in the same sequence as they are received from the feeding mechanism 12. Obviously, the walls 40, 46 may be made of any height such that a sufficient number of documents 41 may be stored so that there is no problem of overflow.

It will also be observed that the buffer unit 14 is able to accommodate a stack of variable thickness documents 41 since the means of conveyance is not dependent upon document thickness. Accordingly, the principles of the instant invention may be used in any situation where mixed thickness documents are conveyed and the inventor's application is not limited to buffer functions only.

What is claimed is:

1. In an apparatus for feeding a document along a path from an upstream end to a down stream end, the combination comprising:

a. a longitudinally extended deck upon which a stack of documents may be placed, said deck having an opening therein;

b. means for supporting said deck at an angle relative to the horizontal, the angle being such that documents placed in a stack upon said deck would tend to slide off one another due to gravity;

c. document supply means located at the upstream end of said deck for feeding documents thereto;

d. means for adjusting the location of said support member on said deck;

e. means for adjusting the location where said supply means feeds documents to said deck;

f. a support member attached to and extending laterally upon said deck, said support member being in a position to prevent documents from sliding from said deck;

g. take-away means located at the downstream end of said deck; and h. a vacuum member received within said opening and positioned to engage the bottommost document of a stack of documents supported by said deck, said vacuum member being operative to convey the bottom-most document in a generally upward direction away from said support member and into engagement with said take-away whereby the friction between the bottom document and the next-to-bottom document is overcome so as to allow the bottom document to be conveyed and the balance of the documents remain in place.

2. The conveying apparatus of claim 1 including a laterally extending wall spaced relative to said support member intermediate said support member and said take-away means.

3. The conveying apparatus of claim 2 including means for moving said wall in a direction generally normal to said deck.

4. The conveying apparatus of claim 1 wherein said vacuum conveying member comprises a chamber having at least one opening therein that is confluent with said deck opening, a foraminous belt disposed about said chamber, means for moving said belt relative to said chamber and means for creating a vacuum in said chamber.

* * * * *

UNITED STATES PATENT AND TRADEMARK OFFICE

CERTIFICATE OF CORRECTION

PATENT NO. : 4,219,191

DATED : August 26, 1980

INVENTOR(S) : Andrew W. Rastorguyeff

It is certified that error appears in the above—identified patent and that said Letters Patent is hereby corrected as shown below:

Column 1, line 15 after "operating" insert -- receiving --

Column 1, line 41 delete the hyphen in bottom-most.

Signed and Sealed this

*Sixth* Day of *October 1981*

[SEAL]

*Attest:*

GERALD J. MOSSINGHOFF

*Attesting Officer*

*Commissioner of Patents and Trademarks*